US009008341B2

(12) United States Patent
Ryan

(10) Patent No.: US 9,008,341 B2
(45) Date of Patent: Apr. 14, 2015

(54) SYSTEM AND METHOD FOR IDENTIFICATION OF A PERIPHERAL DEVICE

(71) Applicant: Semiconductor Components Industries, LLC, Phoenix, AZ (US)

(72) Inventor: James Ryan, Ottawa (CA)

(73) Assignee: Semiconductor Components Industries, LLC, Phoenix, AZ (US)

( * ) Notice: Subject to any disclaimer, the term of this patent is extended or adjusted under 35 U.S.C. 154(b) by 0 days.

(21) Appl. No.: 13/573,749

(22) Filed: Oct. 3, 2012

(65) Prior Publication Data

US 2013/0083949 A1 Apr. 4, 2013

Related U.S. Application Data

(60) Provisional application No. 61/542,391, filed on Oct. 3, 2011.

(51) Int. Cl.
*H04R 25/00* (2006.01)
*H04R 1/10* (2006.01)

(52) U.S. Cl.
CPC ..... *H04R 25/305* (2013.01); *H04R 25/505* (2013.01); *H04R 1/1066* (2013.01); *H04R 25/65* (2013.01); *H04R 2420/03* (2013.01); *H04R 2420/05* (2013.01)

(58) Field of Classification Search
USPC ..... 381/330, 312, 381
See application file for complete search history.

(56) References Cited

U.S. PATENT DOCUMENTS

| | | | | |
|---|---|---|---|---|
| 7,286,678 | B1 | 10/2007 | Bachler | |
| 2004/0047483 | A1 * | 3/2004 | Bauman | 381/330 |
| 2008/0008340 | A1 | 1/2008 | Bachler | |
| 2008/0260193 | A1 * | 10/2008 | Westermann et al. | 381/330 |
| 2009/0052706 | A1 | 2/2009 | Gottschalk | |
| 2009/0103754 | A1 | 4/2009 | Gottschalk | |
| 2010/0111315 | A1 | 5/2010 | Kroman | |
| 2010/0208906 | A1 | 8/2010 | Vonlanthen | |
| 2011/0002489 | A1 | 1/2011 | Schefer | |

FOREIGN PATENT DOCUMENTS

| | | |
|---|---|---|
| JP | 2004111399 | 4/2004 |
| WO | WO 99/09799 | 3/1999 |
| WO | WO 2009/006889 | 1/2009 |
| WO | WO 2009/012603 | 1/2009 |

* cited by examiner

*Primary Examiner* — Davetta W Goins
*Assistant Examiner* — Amir Etesam
(74) *Attorney, Agent, or Firm* — Robert F. Hightower

(57) ABSTRACT

A system and method for identification of a peripheral device is provided. A system and method for automatic parameter adjustment of a destination device based on the identification of a peripheral device is provided.

19 Claims, 15 Drawing Sheets

Code 9

Code 0

Code 1

Code 4

Code 6

Code 3

Code 2

Code 12

Code 9

Code 8

| In1 (Pin 3) | In0 (Pin 2) | Digital Inputs For Out+,Out- = 0,1 | Digital Inputs For Out+,Out- = 1,0 | Code |
|---|---|---|---|---|
| Open | Open | 00 | 00 | 0 |
| Open | Positive | 00 | 01 | 1 |
| Open | Negative | 01 | 00 | 4 |
| Positive | Open | 00 | 10 | 2 |
| Positive | Positive | 00 | 11 | 3 |
| Positive | Negative | 01 | 10 | 6 |
| Negative | Open | 10 | 00 | 8 |
| Negative | Positive | 10 | 01 | 9 |
| Negative | Negative | 11 | 00 | 12 |

*FIG. 13*

| Analog Input (Pin 5) | Analog voltage for Out+,Out- = 0,1 | Analog voltate for Out+,Out- = 1,0 | Code |
|---|---|---|---|
| Open | 0 (float) | 0 (float) | 0 |
| Positive | 0 | $V_d$ | 1 |
| Negative | $V_d$ | 0 | 2 |
| Both | $\beta V_d$ | $\alpha V_d$ | 3 |

*FIG. 19*

| $R_p$ | $R_n$ | α for Out+,Out- = 0,1 | β for Out+,Out- = 1,0 | $R_{total}$ |
|---|---|---|---|---|
| R | R | 0.5 | 0.5 | 2R |
| 3R | R | 0.25 | 0.75 | 4R |
| R | 3R | 0.75 | 0.25 | |
| 7R | R | 0.125 | 0.875 | 8R |
| R | 7R | 0.875 | 0.125 | |
| 15R | R | 0.0625 | 0.9375 | 16R |
| R | 15R | 0.9375 | 0.0625 | |

*FIG. 21*

SYSTEM AND METHOD FOR IDENTIFICATION OF A PERIPHERAL DEVICE

CROSS-REFERENCE TO RELATED APPLICATION

This application claims the benefit of U.S. Provisional Patent Application No. 61/542,391, filed on Oct. 3, 2011, titled "Automatic Identification Of Receiver Type In Hearing Instruments," the disclosure of which is hereby expressly incorporated by reference, and the filing date of which is hereby claimed under 35 U.S.C. §119(e).

BACKGROUND

The present invention relates, in general, to a system and method for peripheral electronic devices, and more particularly, to a system and method for identifying a peripheral device.

In recent years a new class of hearing instruments has emerged to address the instant-fit market. These devices consist of a generic behind-the-ear (BTE) body (or shell) containing electronics, a battery and a microphone coupled to an external loudspeaker or receiver, through a pair of conductors. The receiver is positioned to sit within the ear canal of the patient, earning the title "receiver in the canal" (RIC) device. This design is advantageous since it allows a wide variety of hearing losses to be fitted using the same hearing-aid shell by simply connecting a different receiver at the time of the hearing-aid fitting. The characteristics of the receiver are then more closely tuned to the needs of the individual patient. This allows a faster turn-around time for the patient and helps to lower manufacturing costs since only one style of shell must be manufactured and stocked.

One problem with this approach is that changing the receiver connected to the shell will drastically alter the electro-acoustic characteristics of the hearing aid. The parameters of the hearing aid must then be re-programmed to ensure that they are appropriate to the characteristics of the receiver that is connected.

Accordingly, it is desirable to have a system and method that can automatically detect the model and/or type of a receiver or transducer that is connected to an audio device and then adjust internal parameters of the audio device accordingly.

BRIEF DESCRIPTION OF THE DRAWINGS

FIG. 13 shows an example of possible inputs and outputs for the states of FIGS. 4-12 in accordance with an embodiment of the present invention;

FIG. 19 shows an example of possible inputs and outputs for the states of FIGS. 15-18 in accordance with an embodiment of the present invention;

FIG. 21 shows an example of possible resistor values for the resistor divider network of FIG. 20, and shows example inputs and outputs for the states of FIGS. 15-18 in accordance with an embodiment of the present invention;

For simplicity and clarity of the illustration, elements in the figures are not necessarily to scale, are only schematic and are non-limiting, and the same reference numbers in different figures denote the same elements, unless stated otherwise. The use of the word "approximately" or "substantially" means that a value of an element has a parameter that is expected to be close to a stated value or position. However, as is well known in the art there are always minor variances that prevent the values or positions from being exactly as stated. It is well established in the art that variances of up to at least ten percent (10%) are reasonable variances from the ideal goal of exactly as described. When used in reference to a state of a signal, the term "asserted" means an active state of the signal and inactive means an inactive state of the signal. The actual voltage value or logic state (such as a "1" or a "0") of the signal depends on whether positive or negative logic is used. Thus, "asserted" can be either a high voltage or a high logic or a low voltage or low logic depending on whether positive or negative logic is used and negated may be may be either a low voltage or low state or a high voltage or high logic depending on whether positive or negative logic is used. Herein, a positive logic convention is used, but those skilled in the art understand that a negative logic convention could also be used. The terms "first", "second", "third" and the like in the Claims or/and in the Detailed Description of the Drawings, are used for distinguishing between similar elements and not necessarily for describing a sequence, either temporally, spatially, in ranking or in any other manner. It is to be understood that the terms so used are interchangeable under appropriate circumstances and that the embodiments described herein are capable of operation in other sequences than described or illustrated herein.

DETAILED DESCRIPTION OF THE DRAWINGS

Some of the following embodiments are illustrated using, as an example, a hearing instrument connectable to a peripheral device (e.g., a receiver or a loudspeaker). However, the invention described herein is not limited to use with a hearing instrument. Those skilled in the art will appreciate the application of this description to many other electronic devices, such as, electronic devices operating with other types of peripheral device that receive electrical signals from the electronic devices.

Figure 1:
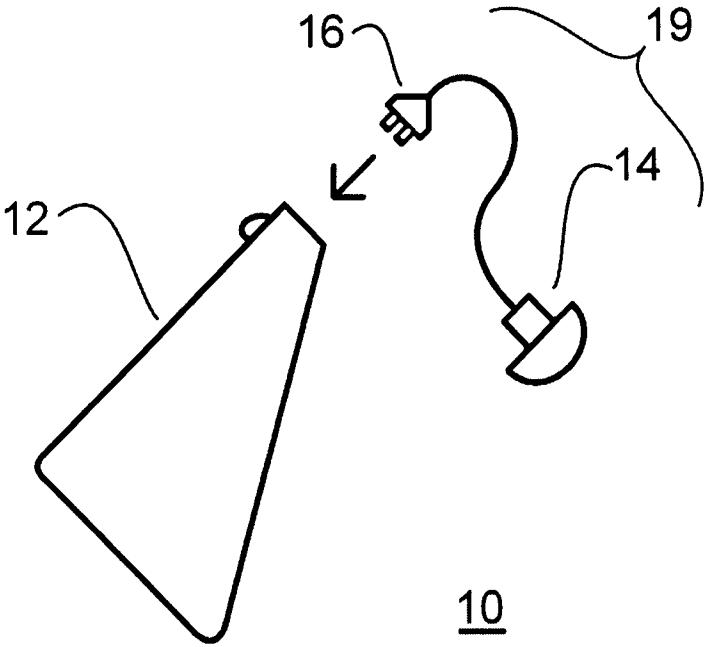
FIG. 1 illustrates an RIC-style hearing in accordance with an embodiment of the present invention.

FIG. 1 illustrates a RIC-style hearing aid 10. In one embodiment, hearing aid 10 can include a hearing aid component or hearing aid shell 12 and a detachable receiver 19. In one embodiment, hearing aid component 12 can include a microphone, amplifier circuitry, battery compartment, battery, push buttons, or other user controls. In one embodiment, detachable receiver 19 can include a receiver, loudspeaker, or receiver housing 14 which can be surrounded by a soft tip designed to provide patient comfort when fitted into the ear canal. The leads of detachable receiver 19 can be brought to a detachable connector 16. In one embodiment, detachable connector 16 can have two pins so that an audiologist may select from a range of different transducers having two pin connectors. In one embodiment, detachable connector 16 can be connected to hearing aid component 12 through the two pins. For example, one of the pins can be connected to a positive amplifier output within hearing aid component 12 and one of the pins can be connected to a negative amplifier output within hearing aid component 12.

In another embodiment, hearing aid 10 can include a detachable connector 16 having more than two pins. In one embodiment, the pins can also be used to encode the receiver-type information. The receiver-type information can be encoded into detachable receiver 19 by cross-connecting amplifier output wires with additional pins. The cross-connections between the pins can be established during the manufacturing of detachable receiver 19 based on the known characteristics of the receiver model. When detachable receiver 19 is connected to hearing-aid component 12, circuitry within hearing-aid component 12 can be configured to detect the cross-connections and decode the corresponding receiver-type information. This method can help, for example, to avoid a manual act of re-adjusting the hearing-aid parameters.

Figure 2:
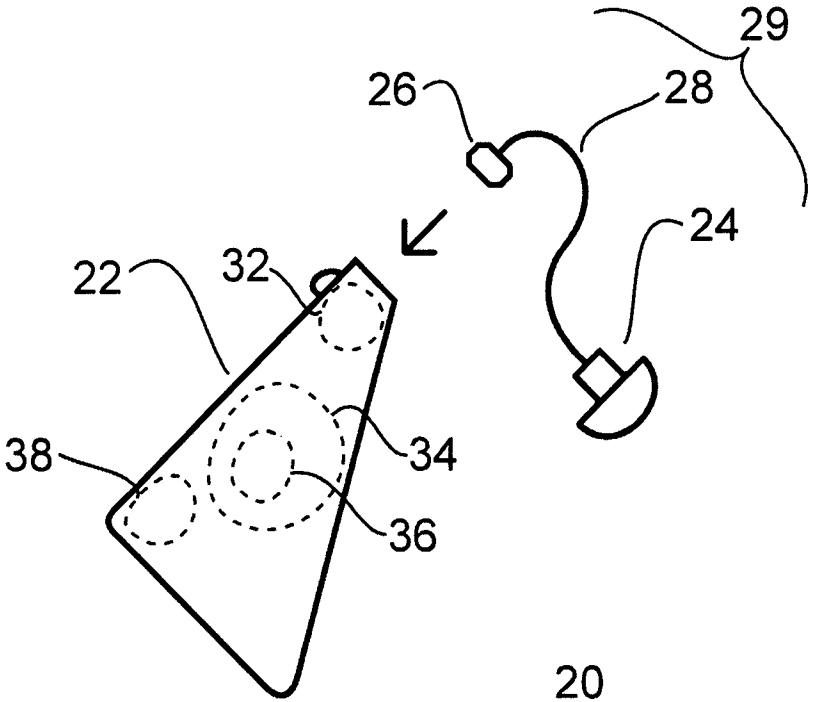
FIG. 2 illustrates a hearing aid to which an automatic identification and parameter adjustment scheme is applied in accordance with an embodiment of the present invention.

FIG. 2 illustrates a hearing aid system 20 to which an automatic identification and parameter adjustment scheme is applied. In one embodiment hearing aid system 20 can include a hearing aid component or hearing aid shell 22 and a detachable receiver 29. In one embodiment, hearing aid component 22 can include an amplifier or amplifier circuitry 34, a microphone, a battery compartment, a battery, and push buttons or other user controls. In one embodiment a detachable receiver 29 can include a hearing aid receiver, speaker or receiver housing 24 which can be surrounded by a soft tip designed to provide patient comfort when fitted into the ear canal. The leads 28 of a detachable receiver 29 can be brought to a detachable connector 26. Hearing aid component 22 can have an interface 32 for connecting detachable connector 26 of detachable receiver 29 to hearing aid component 22.

Detachable connector 26 can be designed for detachable receiver 29 so that it has at least one input or encoding pin and at least one electrical drive pin. During the operation of hearing aid system 20, an electrical signal can be transferred from circuitry within hearing aid component 22 toward detachable receiver 29 via an electrical drive pin. In this example, the electrical drive pin can be connected to an output for amplifier circuitry 34 in hearing aid component 22. The identification of detachable receiver 29 can be embodied by a pin connection arrangement among the input or encoding pin and the electrical drive pin. The pin connection can be implemented, for example, within detachable connector 26 or within receiver housing 24. The pin connection can be detected, for example, during the system start up. If an input or encoding pin is connected to any electrical drive pin, the input or encoding pin will change its state. If an input or encoding pin is unconnected to any electrical drive pin, the input or encoding pin will not change its state.

Amplifier circuitry 34 can include, for example, a decoder 36 for decoding the encoded information of detachable receiver 29 based on the states of the pins. Hearing aid component 22 may also contain a sound processer or controller 38 for adjusting its internal parameters accordingly. Amplifier circuitry 34 and/or the decoder 36 may be in the sound processor 38.

In FIG. 2, components in hearing aid component 22 are schematically illustrated. It would be appreciated by one of ordinary skill in that art that hearing aid component 22 may contain other components not shown in FIG. 2.

The encoding/decoding/parameter adjustment described herein can be applied to hearing instruments with detachable receivers and other electronic devices and systems with any type of detachable peripheral device or loudspeaker connections. In fact, it can be generalized to support identification of any attached peripheral equipment.

For a two-wire detachable connector similar to detachable connector 26 of FIG. 2, there can be three options for connecting each of the encoding pins: not connected (open), connected to the positive amplifier output and connected to the negative amplifier output. Thus, each additional encoding pin can provide three possible encoding values instead of two, as would be obtained with a binary system. Furthermore, each additional pin can provide 3 times more encoding states. For a system with n encoding pins, there can be $3^n$ unique codes. For example, for a system with two additional encoding pins, it is possible to encode $3^2$ or 9 different states.

This encoding system can also be applied to a detachable housing for a stereo, or two-way loudspeaker connection. In this embodiment, there can be two amplifier outputs for each transducer thereby increasing the number of connection states to five: not connected (open), connected to the left positive-amplifier output, connected to the left negative-amplifier output, connected to the right positive-amplifier output, and connected to the right negative-amplifier output. For such a stereo system provided with n digital inputs, it is possible to encode $5^n$ unique identification states.

This concept can be further extended to a system with an arbitrary number of amplifier outputs. For k amplifier outputs and n digital inputs, it is can be possible to encode $(k+1)^n$ identification states.

Referring to FIG. 2, the pin-connection states can be decoded, for example, in amplifier circuitry 34 by applying logical voltage levels to each amplifier output terminal in isolation and simultaneously reading the binary states of the digital input pins or encoding pins. For example, when a logical 1 voltage is applied to the positive amplifier-output terminal, then any digital input pin or encoding pin connected to that signal will also read as 1. If a logical 0 voltage is applied to the positive amplifier-output terminal, then any digital input connected to that signal will also read as 0. Unconnected inputs can be forced into a known state through the use of pull-up or pull-down resistors.

In an example of a single transducer, all possible connection states can be determined by applying two separate excitations: one with the positive amplifier output set to 1 and the negative set to 0; and a second with the positive amplifier output set to 0 and the negative set to 1. These excitations can be for brief periods of time and can be performed as part of a system start-up procedure. For embodiments using multiple transducers, each amplifier output can be excited separately in order to fully identify the connection states. The excitation can be controlled by the decoder 36 or the controller 38.

Figure 3:
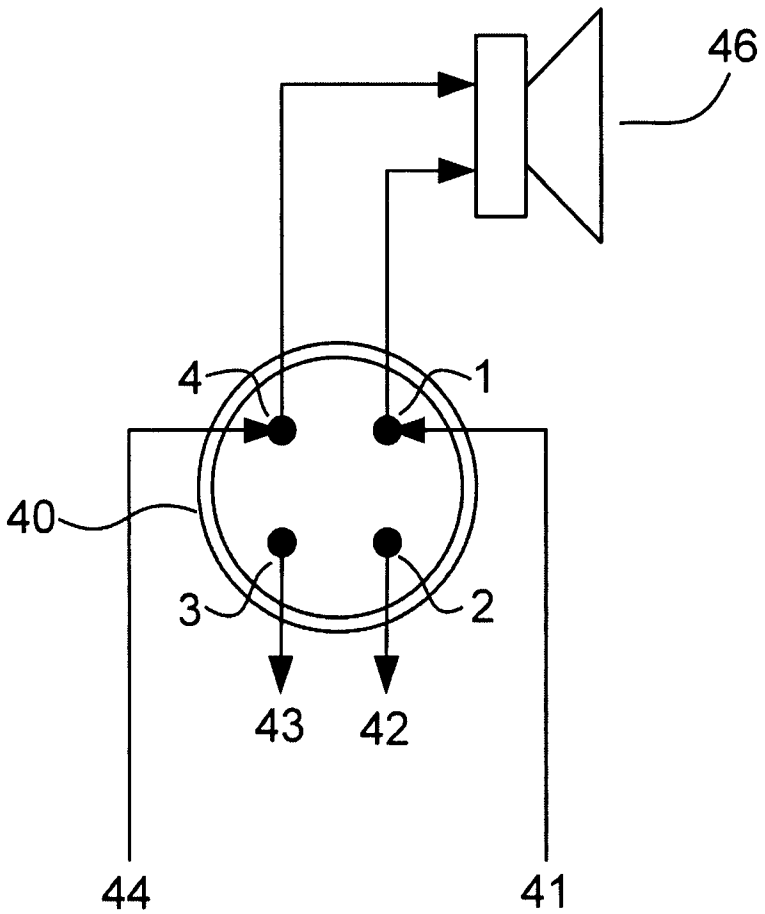
FIG. 3 illustrates an example of a four-pin connector system for use with the detachable receiver or other audio device in accordance with an embodiment of the present invention.

FIG. 3 illustrates an example of a connector or detachable connector 40 for use with a loudspeaker or receiver 46. Connector 40 and receiver 46 can be connected together with leads or wires and can form part of a detachable receiver. Connector 40 can be a two-wire, four-pin connector having pins 1, 2, 3, and 4. Pins 1 and 4 can be assigned or connectable to the outputs 44 and 41 of an amplifier or amplifier circuitry. For example, pin 4 can be connected to a positive output or Out+ of an amplifier or amplifier circuitry, while pin 1 can be connected to a negative output or Out− of an amplifier or amplifier circuitry as illustrated, for example, in FIGS. 4-12. Pins 2 and 3 can be assigned or connectable to digital inputs 42 and 43 that encode loudspeaker-type information. For example, pin 3 can be connected to a first digital input or In1, while pin 2 can be connected to a second digital input or In0 as illustrated, for example, in FIGS. 4-12. The loudspeaker-type information can be encoded using connections between pins 1 or 4 and pins 2 or 3.

As illustrated in FIGS. 4-12, a pin connection can be arranged based on the identification of the receiver. Pins connected to a positive amplifier output or Out+ will follow any Out+ excitation. Pins connected to a negative amplifier output or Out− will follow any Out− excitation.

In FIG. 3, two input pins, 2 and 3, are shown by the way of example. It is appreciated by one of ordinary skill in that art that the number of the input pins may vary from one to many.

FIGS. 4-12 illustrate the various possible connection states for the two-wire, four-pin connector system of FIG. 3, for encoding the loudspeaker-type information. In FIGS. 4-12, "Out+" represents a positive amplifier output, "Out−" represents a negative amplifier output, and "In0" and "In1" represent digital inputs used to encode the receiver states.

Figure 4:
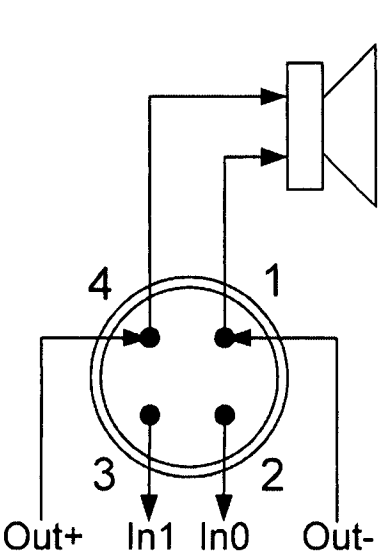
FIGS. 4-12 illustrates possible connection states for the four pin connector system of FIG. 3, for encoding device-type information in accordance with an embodiment of the present invention.
Figure 5:
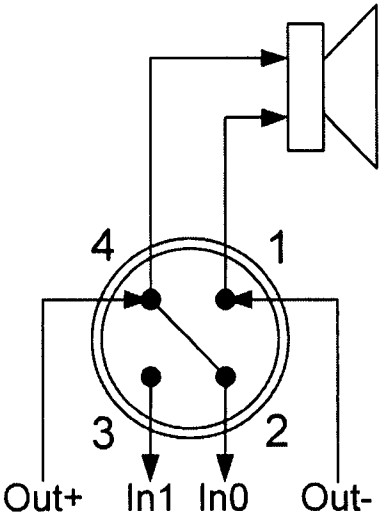
Figure 6:
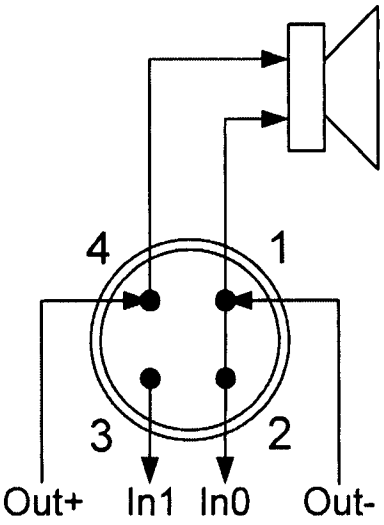
Figure 9:
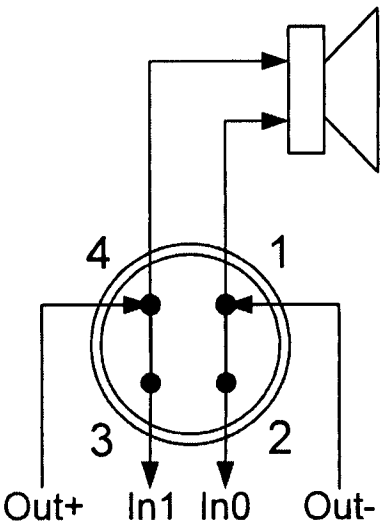
Figure 8:
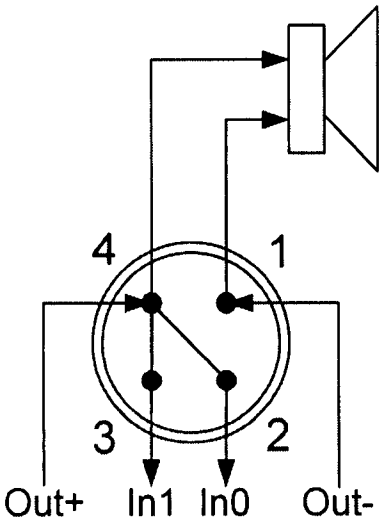
Figure 7:
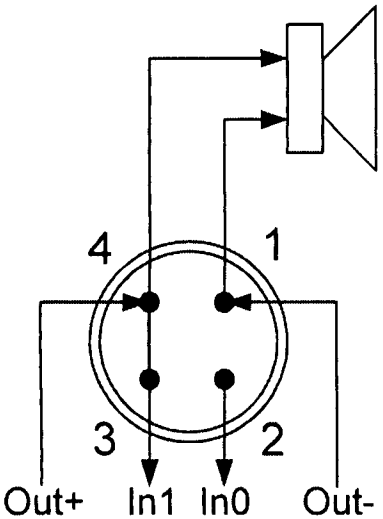
Figure 12:
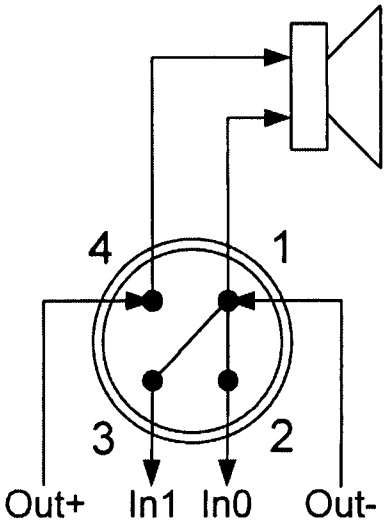
Figure 11:
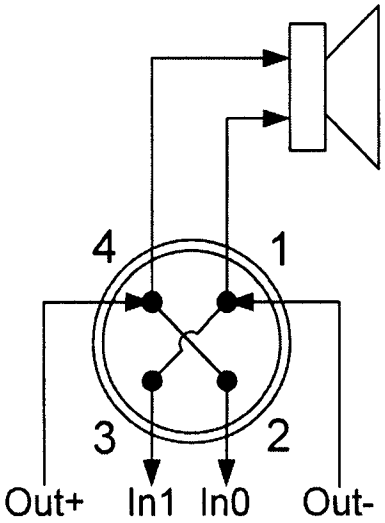
Figure 10:
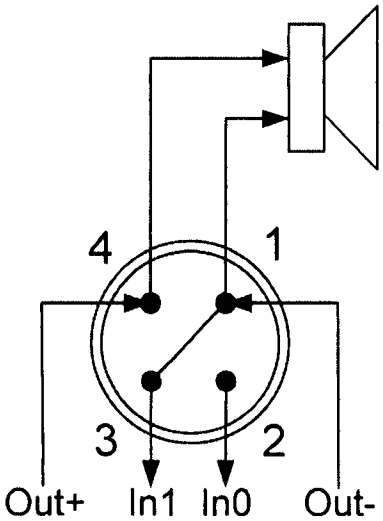

For example, in FIG. 4, pins 1, 2, 3, and 4 are not connected to each other while in FIG. 5, pins 2 and 4 are pre-connected. The pin connection may be implemented by, for example, but not limited to, a short circuit.

As an example of a fully encoded system, each connector diagram of FIGS. 4-12 can show a connection for a unique encoding state: "Code 0", "Code 1", "Code 4", "Code 2", "Code 3", "Code 6", "Code 8", "Code 9", and "Code 12" respectively. As described, the two-wire, four-pin connector system is able to encode nine different states using two digital inputs In0 and In1 (pins 2 and 3).

FIG. 13 illustrates combinations of In0, In1, Out+, and Out− for each state of FIGS. 4-12. In0 is assigned to the least-significant, and In1 is assigned to the most-significant bit of the binary value assigned to the digital pins. It is assumed that the digital inputs pins can be pulled down to a logical 0 state when they are unconnected. The entries in the "Digital Inputs" columns in FIG. 5 contain the binary values read back from the digital input pins for the various connection states. The column labeled "Digital Inputs For Out+, Out−=0,1" shows the binary values obtained when the positive amplifier output is 0 and the negative output is 1. Conversely, the column labeled "Digital Inputs For Out+, Out−=1,0" shows the binary values obtained when the positive amplifier output is 1 and the negative output is 0. The last column indicates the equivalent binary code when the bits from "Out+, Out−=0,1" and "Out+, Out−=1,0" columns are concatenated. As shown in FIG. 5, there are 9 unique, identifiable encoding states: "Code 0", "Code 1", "Code 4", "Code 2", "Code 3", "Code 6", "Code 8", "Code 9", and "Code 12".

While the example shown here uses two digital input pins, any number of input pins can be used, depending on the number of encoding states and on the acceptable hardware complexity.

For low-power audio applications, the audio drive signal for the loudspeaker is often digital in nature. As a result, the application of the required logical voltage levels is straightforward with very simple circuitry. It is, however, also possible to apply the same encoding approach to an amplifier with analog outputs, as long as the output voltage-drive of the amplifier is compatible with the logical voltage thresholds for the digital inputs.

In another embodiment, one or more identification pins (pins for In0 and/or In1) can be connected to circuitry that is capable of measuring an analog voltage level. In this case, the short-circuit connections of FIGS. 4-12 can be optionally be replaced by resistive connections (or a resistor divider network) thereby providing a larger number of possible encoding states, as described below.

Figure 14:
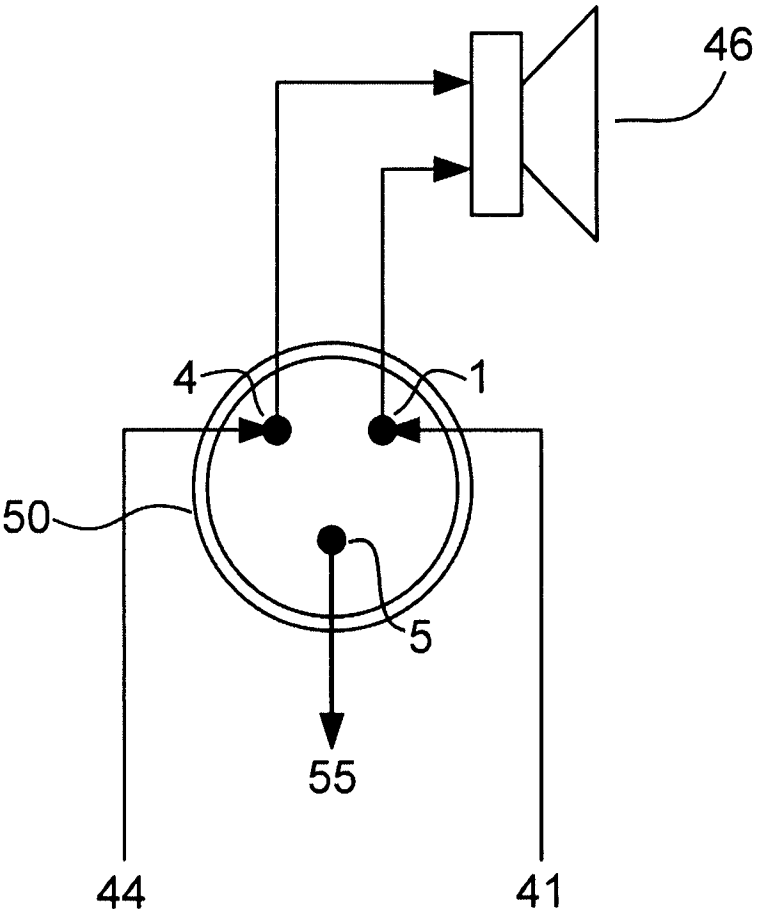
FIG. 14 illustrates an example of a three-pin connector system for use with a detachable receiver or other audio device in accordance with an embodiment of the present invention.

FIG. 14 illustrates an example of a connector 50 for use with a detachable loudspeaker or receiver 46. Connector 50 and receiver 46 can be connected together with leads or wires and can form part of a detachable receiver. Connector 50 can be a two-wire, three-pin connector having pins 1, 4 and 5. Pins 1 and 4 can be assigned or connectable to the outputs 44 and 41 of an amplifier or amplifier circuitry. For example, pin 4 can be connected to a positive output or Out+ of an amplifier or amplifier circuitry, while pin 1 can be connected to a negative output or Out− of an amplifier or amplifier circuitry as illustrated, for example, in FIGS. 15-18. Pin 5 can be assigned or connectable to an analog input 55 that encodes loudspeaker-type information. For example, pin 5 can be connected to a first analog input or "Analog In" as illustrated, for example, in FIGS. 15-18. The loudspeaker-type information can be encoded using connections or resistors between pins 1 or 4 and pin 5. Depending on the choice of resistor values, system 50 is able to encode at least four different states using the single analog input pin 5.

In FIG. 14, one input pin is shown by the way of example, however, it is appreciated by one of ordinary skill in that art that the number of the input pins may vary.

FIGS. 15-18 illustrate various possible connection states for the three-pin connector system of FIG. 14, for encoding the loudspeaker-type information. As an example of a fully encoded system, each connector diagram of FIGS. 15-18 shows a connection for a unique encoding state: "Code 0", "Code 1", "Code 2", and "Code 3" respectively.

Figure 16:
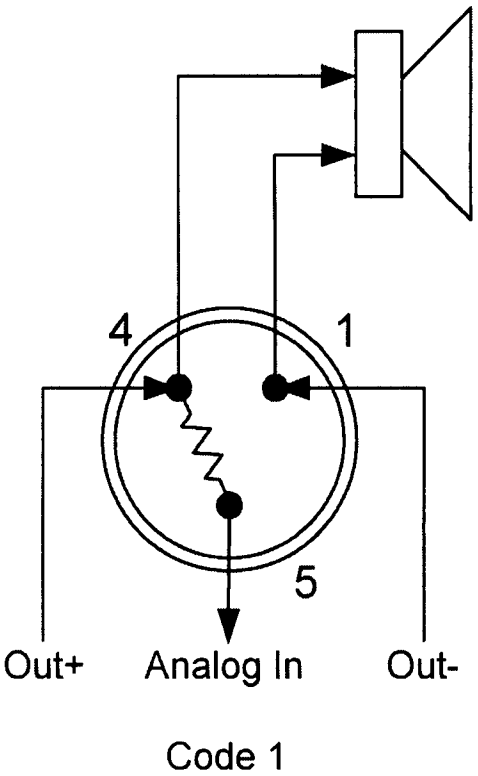
FIGS. 15-18 illustrates possible connection states for the three-pin connector system of FIG. 14, for encoding device-type information in accordance with an embodiment of the present invention.
Figure 15:
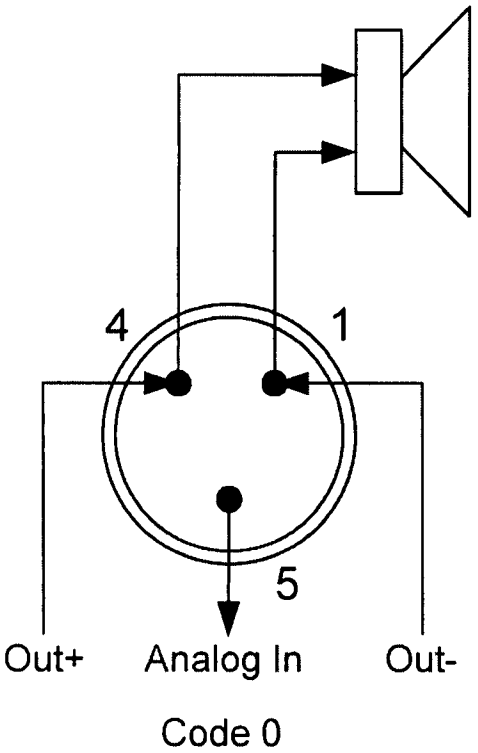
Figure 18:
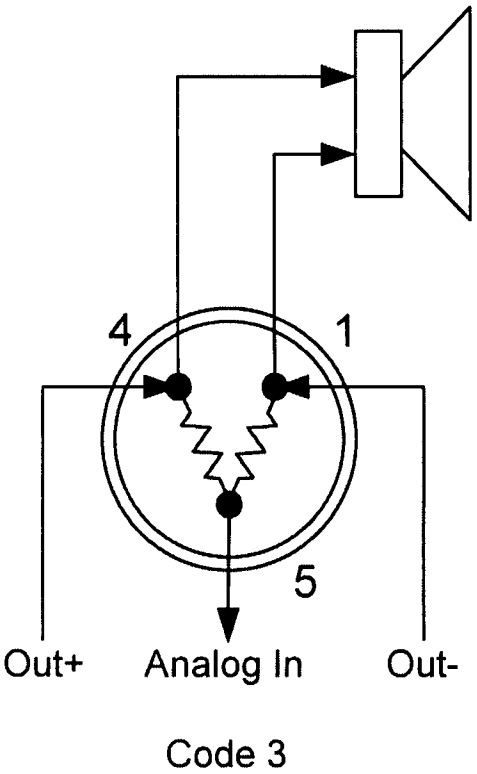
Figure 17:
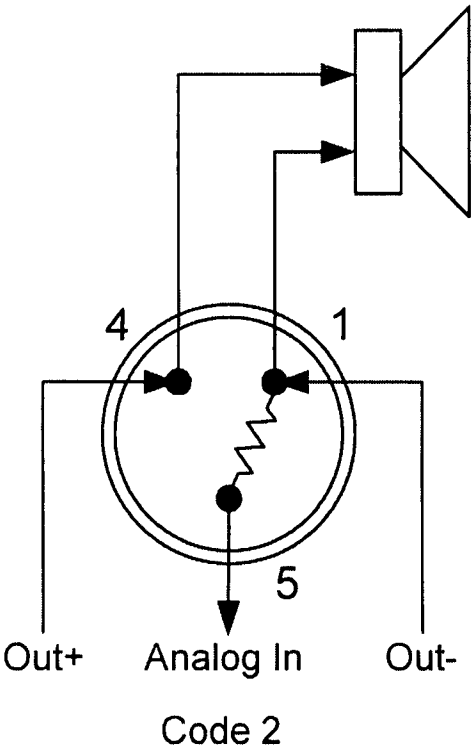

For example, in FIG. 15, pins 1, 4 and 5 are not connected each other. In FIG. 16, pins 4 and 5 are pre-connected by a resistor. In FIG. 17, pins 5 and 1 are pre-connected by a resistor. In FIG. 18 pins 5 and 1 are pre-connected by a resistor and pins 5 and 4 are pre-connected by another resistor.

The analog input "Analog In" may be left floating, or may be connected through a resistor to the positive amplifier output Out+, the negative amplifier output Out− or to both, as shown in FIGS. 15-18. Additional states may be encoded in the case when both amplifier outputs Out+ and Out− are connected by using different resistor values.

FIG. 19 illustrates combinations of Analog In, Out+ and Out− for each state of FIGS. 15-18. The entries in the "Analog Input" column in FIG. 19 contain a state of pin 5 for the various connection states. The column labeled "Analog voltage for Out+, Out−=0,1" shows values obtained when the positive amplifier output Out+ is 0 and the negative output Out− is 1. Conversely, the column labeled "Analog voltage for Out+, Out−=1,0" shows values obtained when the positive amplifier output Out+ is 1 and the negative output Out− is 0. The last column indicates the equivalent binary code when the values from "Out+, Out−=0,1" and "Out+, Out−=1,0" columns are concatenated. As shown in FIG. 19, there are 4 unique, identifiable encoding states: "Code 0", "Code 1", "Code 2", and "Code 3".

In FIG. 19, "$V_d$" represents the maximum amplifier drive voltage. The voltage measured on the analog input can vary with the connection states and excitation. When the input is floating, the voltage can be determined by the presence of a suitable pull-up or pull-down resistor. When the input is connected to a single amplifier output, the voltage can be determined by the drive voltage level (0 or $V_d$). When the input is connected to both amplifier outputs, the voltage can be determined by the drive voltage on both outputs as well as the resistor-divider network formed between the amplifier outputs. As an example, assuming that one amplifier output is always at 0 while the other is at $V_d$, the observed voltage will always be a fraction of the amplifier drive voltage, $V_d$. These states are summarized in FIG. 19, where the fractional values $\alpha$ and $\beta$ represent the effect of the resistor-divider network (see FIG. 20).

Figure 20:
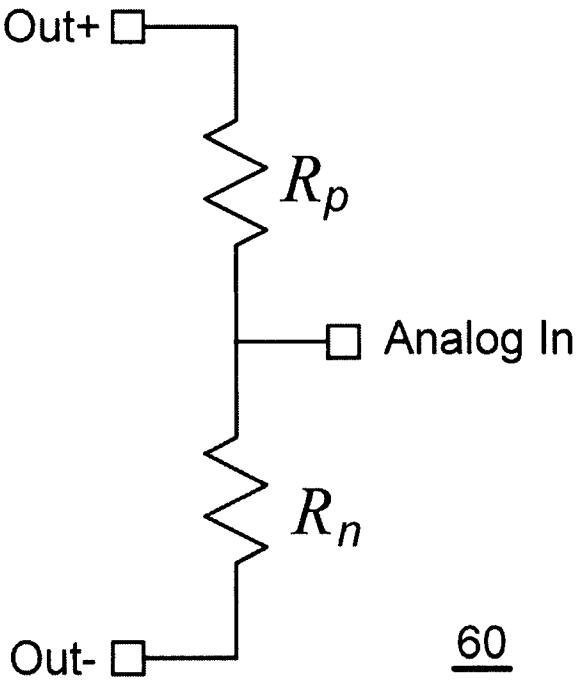
FIG. 20 illustrates an example of a resistor divider network applicable to a connector having an analog input in accordance with an embodiment of the present invention.

FIG. 20 illustrates an example of a resistor divider network applicable to the connector system of FIG. 14. The resistor divider network 60 includes a plurality of resistors. The resistor divider network 60 is formed when the positive and negative amplifier outputs (Out+, Out− of FIG. 14) are connected to the analog input (pin 5 of FIG. 14) through the resistors. In FIG. 20, two resistors $R_p$ and $R_n$ are shown by way of example. The resistor $R_p$ is coupled to Out+ and Analog In. The resistor $R_n$ is coupled to Out− and the Analog In. The voltage at the Analog In depends on the ration between $R_p$ and $R_n$.

Due to the ability to connect both amplifier outputs to the single, Analog In (pin 5 of FIGS. 14-18, and Analog In of FIG. 20), the number of encoding states has increased compared to the digital case described above, according to the measurement resolution of the analog input. In fact, when both amplifier outputs are connected at the same time, it is possible to encode more than a single state by selecting resistor values, as described below.

The resistor-divider ratios, $\alpha$ and $\beta$, can be determined by the relative values of the resistors connected to the positive amplifier output Out+ and the negative amplifier output Out−. The $\alpha$ resistor divider is obtained when $V_d$ is applied to the positive amplifier output Out+ and 0 is applied to the negative amplifier output Out−. The $\beta$ resistor divider is obtained when $V_d$ is applied to the negative amplifier output Out− and 0 is applied to the positive amplifier output Out+. The resulting equations are:

$$\alpha = \frac{R_n}{R_p + R_n} \text{ and } \beta = \frac{R_p}{R_p + R_n}.$$

FIG. 21 shows examples of possible choices for $R_p$ and $R_n$ and the resulting resistor-divider values observed at the analog input. For generality, the resistor values are described relative to a common base resistance value, R. The last column of the table shows the total resistance between the amplifier outputs:

$$R_{Total}=R_p+R_n$$

The entries in FIG. 21 demonstrate that it is possible to select resistor values that result in unique voltage levels at the analog input. If the voltage on the analog input can be measured with sufficient accuracy, then each of the states in FIG. 21 can be detectable and can be used to encode more information.

For example, if the analog input is connected to a uniformly spaced, analog-to-digital converter (ADC) with a range from 0 to $V_d$ and a resolution of three bits, the voltages shown in the above table can be resolved. Thus, the proposed encoding scheme using a single analog input is capable of encoding ten unique states: three from the connection states and seven from the resistor ratios. In situations where a more accurate ADC is available, the total number of encoding states can be increased further.

Given sufficient room for additional resistors, the above encoding approach can be extended to multiple analog input pins. In this case, the connections for each additional input can be encoded and decoded in the same way as for the single-input case.

Information can be encoded using only the connection states and the relative resistance values for $R_p$ and $R_n$ (when both amplifier outputs are used). In terms of the encoding, no further restrictions need to be placed on the resistors.

Figure 22:
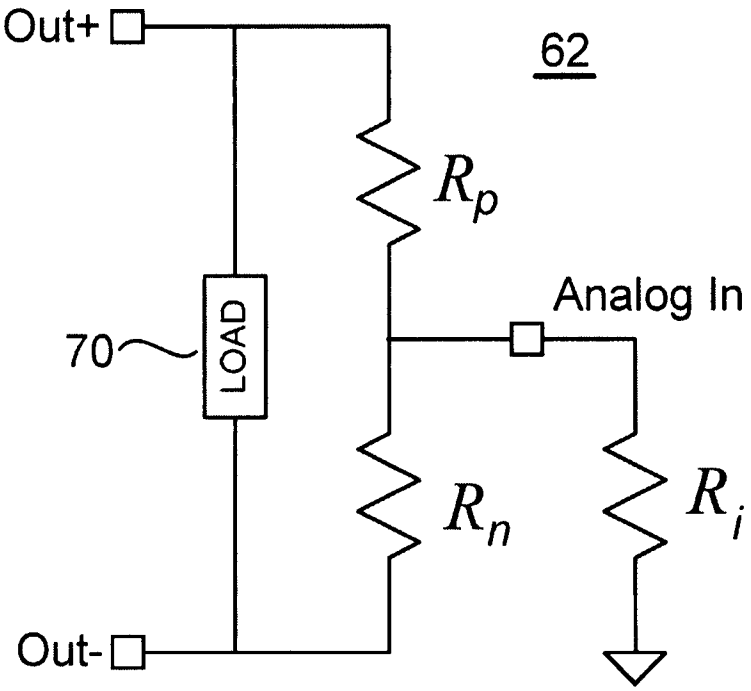
FIG. 22 illustrates an example of the resistor divider network of FIG. 20 connected to a receiver system in accordance with an embodiment of the present invention.

FIG. 22 illustrates the resistor divider network 62 connected in a receiver system. The impedance of the receiver or loudspeaker is represented by the load 70 impedance across the amplifier outputs Out+ and Out−. The input impedance of the analog input is represented by $R_i$, connected between the input terminal and ground.

Both the load and input impedances can be considered in selecting the resistor values $R_p$ and $R_n$. In one embodiment, to minimize load on the amplifier and to power consumption, the resistance values can be chosen much greater than the load impedance. In another embodiment, to maximize voltage measurement accuracy, the resistors can be chosen to be less than the input impedance.

In one embodiment, the identification resistors can be built into a detachable housing and can be permanently connected across the load during normal operation. Consequently, the resistors can be chosen large enough so that they do not represent a significant additional load on the amplifier or a significant additional power drain on the system. Furthermore, since the total resistance varies with the encoding (as shown in FIG. 21), receivers with a particularly high impedance can be identified using a connection arrangement that represents a higher impedance across the load. Encodings that represent a lower total resistance can be used to identify less-sensitive loads. While analog inputs can be designed for a high input impedance, practical considerations can limit what is achievable to about 1 Mega-ohm or less.

In FIG. 22, the analog input impedance appears in parallel across either $R_p$ and $R_b$, depending on the excitation. Generally, any current that flows into the analog input may not flow through the parallel resistor and may disturb the measured voltage. This disturbance can be minimized by choosing resistor values that are much lower than the input impedance. However, this choice may also depend on the required accuracy and the maximum number of encoding states.

In one embodiment, receiver (load) impedances can be on the order of 100 to 1000 ohms. Analog input impedances can be on the order of $10^6$ ohms. In this embodiment, identification resistors could be chosen in the range from $10^4$ to $10^5$ ohms.

Figure 23:
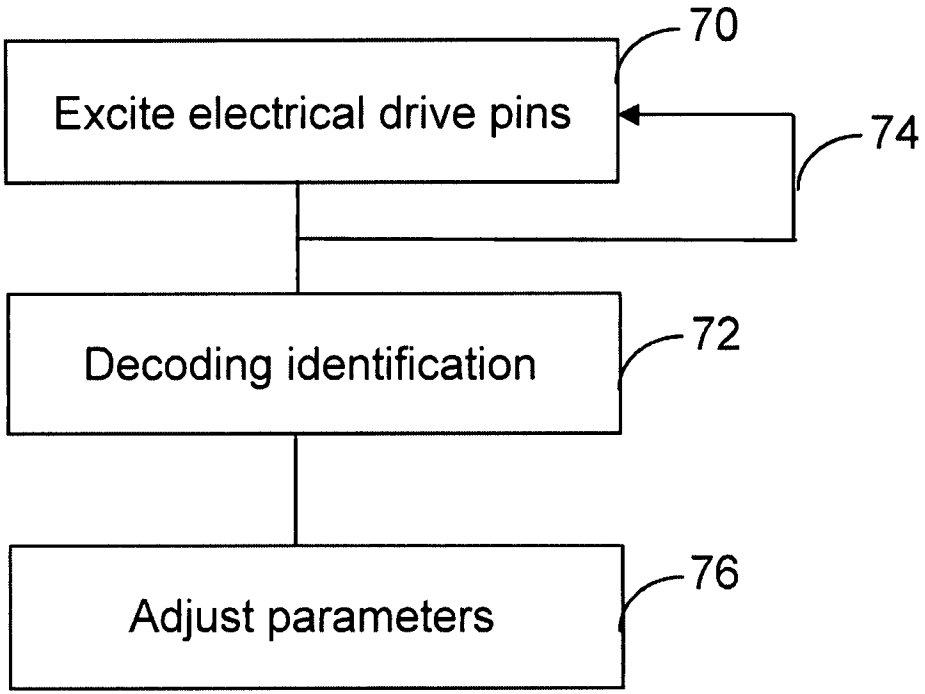
FIG. 23 shows an example of an operation flow for an identification and parameter adjustment scheme in accordance with an embodiment of the present invention.

FIG. 23 illustrates an operation flow for the identification of peripheral devices. In one embodiment, the operation flow can be applied to the hearing aid described in FIG. 2. For example, during act 70, decoder 36 can sequentially excite at least one of the electrical drive pins or amplifier output pins and during act 72 the decoder can determine the identification of the receiver based on the states or voltages of the plurality of electrical drive pins and the input pin or pins. Act 74 represents that the excitement may be done until the observation of all possible combinations of the states or voltages of the plurality of electrical drive pins and the states or voltages of the input pin or input pins is completed. During act 76, controller 38 can automatically adjust internal parameters for operation of the hearing aid to operate with the receiver. The operation flow of FIG. 23 can be performed, for example, during the system start up.

As described above, encoding can be implemented by digital encoding of information using cross-connections between output-drive pins and digital-input pins, encoding of information using resistor cross-connections between output-drive pins and analog-input pins, and/or combinations thereof. The detection of cross-connection status can be based on selective excitation of the electrical drive pins. The signal-processing characteristics in the hearing-aid housing can be adapted based on decoding of the information encoded in the connection states.

It is noted that the above description and application of the encoding/decoding and parameter adaptation for hearing aids is intended as a non-limiting example. The application of the encoding/decoding and parameter adaptation can be applied to other types of electronic and audio devices and peripherals, for example, the above described systems and methods can be applied to the detection of other types of peripherals attached to an amplifier.

According to various embodiments and examples described above, the automatic receiver detection feature for preconfigured hearing-instrument products may not require changes to the receiver circuitry (silicon or hybrids). If desired, the encoding system can be fully contained within the connector housing. This helps minimize the size of the connector. According to some embodiments, it is not required to add additional passive or active components into the detachable receiver housing. According to some embodiments, using digital inputs can provide the ability to encode $2^n$ states using n digital input, thereby ensuring hardware efficiency. According to some embodiments, using analog inputs can provide the ability to encode $4^n$ states using n analog inputs, thereby ensuring hardware efficiency. Furthermore, according to some embodiments, the system allows for use of the digital nature of the H bridge power amplifier stage to directly interface with digital logic pins. Additionally, according to some embodiments, the resistor encoding system may not require the direct measurement of resistance or impedance.

According to one embodiment a system can include a plurality of pins having at least one input pin and at least one electrical drive pin for transferring an electrical signal output from a destination device to a detachable peripheral device and at least one input pin. Furthermore, an interconnection can be arranged between the at least one electrical drive pin and the at least one input pin, for encoding the identification of the detachable peripheral device.

According to another embodiment a destination device can include a decoder for identifying a peripheral device. The decoder can include a module for selectively exciting electrical drive pins in a predetermined level and a module for decoding the identification of the peripheral device based on the states of the electrical drive pins and at least one input pin.

According to another embodiment a method includes selectively exciting at least one electrical pin in a predetermined level and decoding the identification of peripheral device based on the voltages of the at least one electrical drive pin and at least one input pin.

According to another embodiment there is provided a system for automatic identification of a detachable peripheral device connectable to a destination device, which includes: a plurality of pins having at least one electrical drive pin for transferring an electrical signal output from the destination device to the detachable peripheral device, and at least one input pin; and an interconnection arranged between the at least one electrical drive pin and the at least one input pin, for encoding the identification of the detachable peripheral device. The plurality of pins are connected to the destination device when the destination device operates with the peripheral device.

According to another embodiment there is provided a system for configuration of a first device operable with a detachable second device that is a peripheral of the first device, which includes: a decoder for identifying the second device coupling to the first device via a connector, the connector having at least one electrical drive pin and at least one input pin, a pin connection being arranged between the at least one electrical drive pin and the at least one input pin, the second device operating with a signal from the at least one electrical drive pin, the decoder including: a module for selectively exciting at least one electrical pin in a predetermined level; and a module for decoding the identification of the second device, based on the states of the at least one electrical drive pin and the at least one input pin.

According to another embodiment there is provided a method of configuring a first device operable with a detachable second device that is a peripheral of the first device, which includes: identifying the second device coupling to the first device via a connector, the connector having at least one electrical drive pin and at least one input pin, a pin connection being arranged between the at least one electrical drive pin and the at least one input pin, the second device operating with a signal from the at least one electrical drive pin, the step of identifying including: selectively exciting at least one electrical pin in a predetermined level; and decoding the identification of the second device, based on the states of the at least one electrical drive pin and the at least one input pin.

While the subject matter of the invention has been described with specific preferred embodiments and example embodiments, the foregoing drawings and descriptions thereof depict only typical embodiments of the subject matter and are therefore not to be considered to be limiting of its scope, it is evident that many alternatives and variations will be apparent to those skilled in the art.

What is claimed is:

1. A system for automatic identification of a peripheral device, comprising:

a plurality of pins, the peripheral device being detachably connectable to a destination device via the plurality of pins, the plurality of pins including:

one or more drive pins for operation of the peripheral device in conjunction with the destination device, and one or more input pins; and an interconnection arranged among the plurality of pins for encoding the identification of the peripheral device wherein the interconnection arrangement includes at least one input pin of the one or more input pins coupled to receive a signal applied to at least one drive pin of the one or more drive pins, the drive pin configured to transfer an output of an amplifier in the destination device to a loudspeaker in the peripheral device.

2. The system according to claim 1, wherein the interconnection arranged among the plurality of pins comprises a resistor or a short circuit.

3. The system according to claim 1, wherein the peripheral device is a replaceable device comprising a receiver for an audio output based on the output of the amplifier.

4. The system according to claim 1, wherein an audio processing in the destination device is adapted based on the identification of the peripheral device.

5. The system according to claim 1, wherein the interconnection arrangement is formed in a connector in the peripheral device, the connector being connectable to the destination device.

6. The system according to claim 1, wherein the interconnection arrangement is formed in a receiver in the peripheral device.

7. A system for configuration of a first device for operation with a second device, comprising:

an interface connectable to the second device via a plurality of pins, the plurality of pins comprising one or more input pins and one or more drive pins for operation of the second device in conjunction with the first device, an interconnection being arranged among the plurality of pins for encoding the identification of the second device; and a first circuit configured to selectively operate on the one or more drive pins and decode a state of at least one input pin of the plurality of pins in response to a signal applied to at least one drive pin to identify the second device based on the state of the plurality of pins, the at least one drive pin configured to couple an audio signal to drive a loudspeaker.

8. The system according to claim 7, comprising:

a second circuit configured to adjust audio processing in the first device based on decoding the state of the plurality of pins.

9. The system according to claim 7, wherein the first circuit comprises:

circuitry configured to selectively excite the one or more drive pins and decode the state of the plurality of pins in a set up procedure of the first device.

10. The system according to claim 7, wherein the first circuit comprises:

circuitry configured to operate on an amplifier in the first device to identify the second device, the amplifier being operable for the identification of the second device and an audio output from the second device.

11. The system according to claim 10, wherein an output of the amplifier is transferred to the at least one drive pin, for the audio output from the peripheral device.

12. The system according to claim 11, wherein the first device is a hearing instrument, and wherein the second device is a replaceable device comprising a receiver for the audio output.

13. A method of configuring a first device detachably coupled to a second device, comprising:

configuring one of the first device or the second device to identify the second device coupled to the first device via a plurality of pins, the plurality of pins comprising one or more input pins and one or more drive pins for operation of the second device in conjunction with the first device, an interconnection being arranged among the plurality of pins for encoding the identification of the second device, wherein the one or more drive pins are configured to couple an audio signal to a loudspeaker, and wherein identifying the second device includes:

configuring one of the first device or the second device to selectively operate on the one or more drive pins; and configuring one of the first device or the second device to decode a state of the plurality of pins to identify the second device based on the state of the plurality of pins wherein the state includes a drive signal coupled to the drive pin from one of the first device or the second device.

14. The method of claim 13, comprising:

configuring the first device to adjust audio processing based on decoding the state of the plurality of pins.

15. The method of claim 13, wherein configuring one of the first device or the second device to selectively operate on the one or more drive pins comprises:

configuring one of the first device or the second device to sequentially excite the one or more drive pins.

16. The method of claim 15, wherein configuring one of the first device or the second device to decode the state of the plurality of pins comprises:

configuring one of the first device or the second device to decode the state of the plurality of pins in response to exciting the one or more drive pins.

17. The method of claim 13, wherein configuring one of the first device or the second device to identify the the second device is implemented in a set-up procedure of the first device.

18. The method of claim 13 wherein configuring one of the first device or the second device to decode the state of the plurality of pins includes coupling at least one input pin of the one or more input pins to receive the drive signal that is applied to at least one drive pin.

19. The method of claim 13 wherein configuring one of the first device or the second device to decode the state of the plurality of pins includes configuring one of the first device or the second device to couple the drive signal from an output of an amplifier to at least one input pin.

* * * * *